United States Patent [19]

Pomponi, Jr.

[11] 4,401,268

[45] Aug. 30, 1983

[54] SPRAY GUN WITH PAINT AGITATOR

[75] Inventor: Edward A. Pomponi, Jr., Boulder, Colo.

[73] Assignee: Binks Manufacturing Company, Franklin Park, Ill.

[21] Appl. No.: 298,765

[22] Filed: Sep. 2, 1981

[51] Int. Cl.[3] ..... B01F 13/00

[52] U.S. Cl. ..... 239/142; 366/260; 366/332; 366/605

[58] Field of Search ..... 239/142, 144; 366/256, 366/260, 332, 605

[56] References Cited

U.S. PATENT DOCUMENTS

| | | | |
|---|---|---|---|
| 2,780,444 | 2/1957 | Hickey | 366/332 |
| 3,672,645 | 6/1972 | Terrels et al. | 239/142 X |
| 4,184,778 | 1/1980 | Terrels | 239/142 X |

*Primary Examiner*—Andres Kashnikow

*Attorney, Agent, or Firm*—Gary, Juettner & Pyle

[57] ABSTRACT

An improved spray gun assembly includes a fluid supply container connected to a spray gun and a manually operable trigger for actuating the spray gun, in combination with a motor driven agitator for automatically agitating the fluid contents of the supply container. The agitator is driven by an air motor, and comprises a paddle which is reciprocated in the fluid contents in directions perpendicular to the plane in which it lies.

5 Claims, 4 Drawing Figures

SPRAY GUN WITH PAINT AGITATOR

BACKGROUND OF THE INVENTION

The present invention relates to spray guns for spraying liquids such as paint or the like, and in particular to a spray gun assembly including a paint supply container having motor driven agitator means for automatically mixing the paint in the container.

In the spraying of paints and other suspensions by means of a spray gun assembly including a spray gun and an associated paint supply container, it is desirable to provide agitation of the paint in the supply container to prevent suspended pigments from settling to the bottom of the container and to produce optimum distribution of pigment in the vehicle. It will be obvious that in the spraying of various liquids other than paint, it is often necessary to provide for agitation in the supply container to effect proper mixing of the various components of the liquid to be sprayed.

Prior attempts to agitate paint within a supply container include the provision of movable agitator members inside of the container, whereby upon manual shaking of the container the agitator members move about within the container and produce mixing of the contents therein. However, such an expedient is subject to the disadvantage that it is not automatic, and thus repeated manual shaking of the container is required to maintain thorough mixing.

Another type of prior agitator for a paint supply container of a spray gun having a manually operable trigger mechanism is described in U.S. Pat. No. 3,412,937. As taught therein, an agitator member is disposed within the paint supply container and secured to an agitator rod which projects outwardly of the container. The rod is engageable by the spray gun trigger mechanism for actuation thereby, whereby each time an operator squeezes the trigger to produce a spray of paint, the resulting movement of the trigger automatically imparts movement to the agitator within the container to effect mixing of the paint supply. A disadvantage of such an arrangement, however, is that if the spray gun assembly is allowed to sit idle for a period of time, and unless the gun is triggered relatively frequently, pigment tends to settle in the bottom of the container.

Yet another contemplated agitator comprises a rotary impeller disposed in the paint supply container and driven by motor means. Although such agitators operate relatively continuously and maintain agitation of the paint, the mixing obtained with rotary impellers has been less than satisfactory.

OBJECTS OF THE INVENTION

An object of the present invention is to provide a paint spray gun assembly including a supply container having an effective agitator for automatically and substantially continuously effecting mixture of the contents of the container.

Another object of the invention is to provide such an agitator which includes a substantially flat paddle extended into the container and reciprocable therein in directions generally perpendicular to the plane in which it lies.

A further object of the invention is to provide such an agitator wherein the paddle is coupled with an air motor for being reciprocated continuously and for as long as air is provided to the motor.

SUMMARY OF THE INVENTION

In accordance with the present invention there is provided, in combination with a spray gun assembly of the type including a hand operated spray gun and an associated supply container, an agitating mechanism for mixing the contents of the supply container. The agitating mechanism includes an agitator carrying member one end of which extends into the interior of said container; an agitator paddle disposed interiorly of said container and mounted on said one end of said carrying member; and motor means connected with an opposite end of said carrying member for reciprocating said carrying member and thereby said paddle along a linear path, whereby said paddle agitates contents of said container.

In a preferred embodiment said agitator paddle is generally flat and planar and is reciprocated along a path generally perpendicular to the plane thereof, said motor means comprises an air motor, and said supply container is provided with a top closure member and said motor means is mounted on said closure within said container.

The foregoing and other objects, advantages and features of the invention will become apparent upon a consideration of the following detailed description, when taken in conjunction with the accompanying drawings.

DETAILED DESCRIPTION

Figure 1:
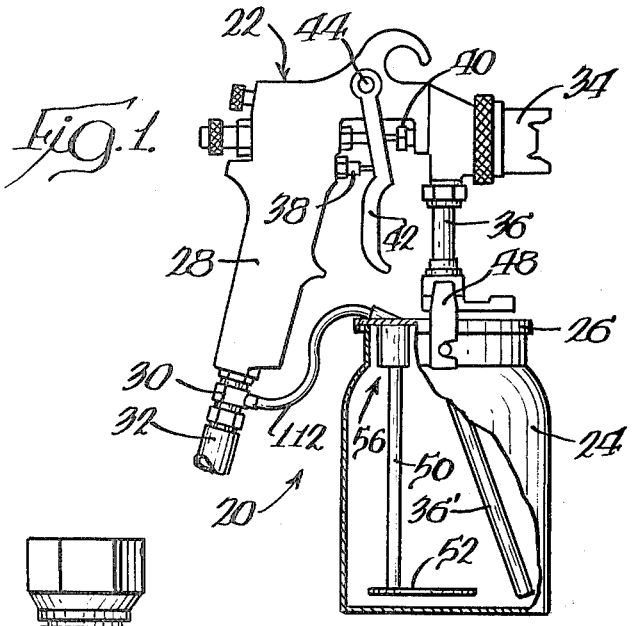
FIG. 1 is a side elevation view of a spray gun assembly including a fluid supply container, embodying an agitator mechanism constructed in accordance with the present invention.

Referring to the drawings which illustrate salient features of a preferred embodiment of the invention, and in particular to FIG. 1, a paint spray gun assembly 20 includes a spray gun 22, a paint supply container 24 and a top closure member or lid 26 which substantially seals the upper end of the supply container. The spray gun includes a handle 28 having an air inlet 30 for receiving air under pressure through a supply line 32, and an outlet nozzle 34 for emitting a paint spray, the paint being drawn up from the container to the nozzle through a syphon tube 36 having a lower extension 36' which projects down into the container adjacent the bottom thereof. The spray gun 22 further includes a valve means 38 movable between open and closed positions to control the flow of pressurized air through the device, valve means 40 movable between open and closed positions to control the flow of paint through the nozzle 34 and a manually operable trigger 42 for controlling operation of the valves 38 and 40. The trigger is pivotally mounted at its upper end by a pivot pin 44, and is movable between a closed or inoperative position away from the handle 28 and an open or operative position toward the handle. The valves 38 and 40 are normally biased to closed position and the trigger is biased thereby to the inoperative position, and the trigger may be manually squeezed by an operator to move the valves to open position. The cover 26 has a seal 46 for sealing with an upper rim of the container, the container is held beneath the cover by a yoke 48 and, although not shown, it is understood that a relatively small vent hole is formed through the cover to permit entry of air into the container as paint is removed therefrom.

Figure 2:
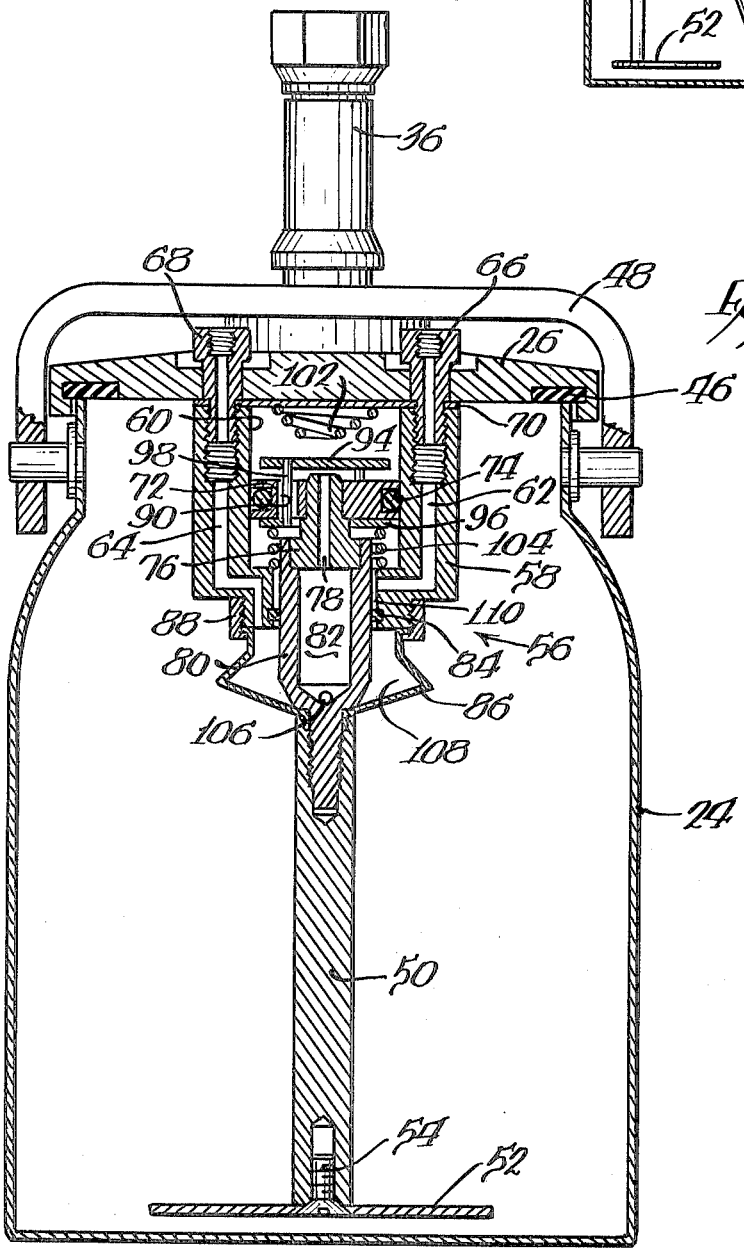
FIG. 2 is a cross-sectional side elevation view of the supply container and agitator mechanism, showing the structural details of an air motor of the agitator mechanism.
Figure 3:
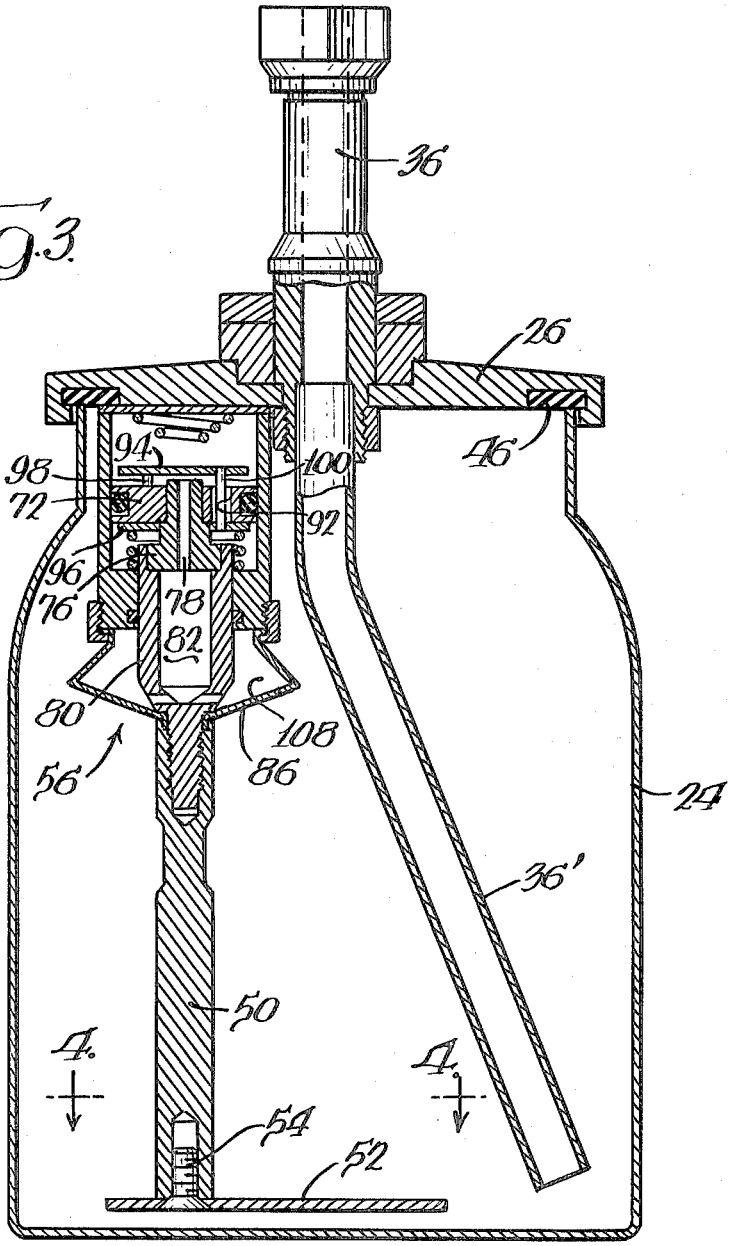
FIG. 3 is a cross-sectional side elevation view of the supply container and agitator mechanism, taken substantially at right angles to the view of FIG. 2, and shows additional structural details of the air motor.
Figure 4:
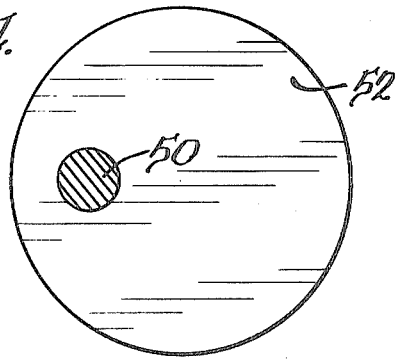
FIG. 4 is a plan view taken along the lines 4—4 of FIG. 3, and shows the configuration of an agitator paddle of the agitator mechanism.

Referring in particular to FIGS. 2–4, the agitator mechanism of the invention includes an agitator carrying member or rod 50 having a relatively flat agitator paddle 52 mounted on its lower end by means of a screw 54 and connected at its upper end to a motor means, indicated generally at 56. The motor means reciprocates the rod in directions along its length, thereby reciprocating the paddle in directions perpendicular to the plane in which it lies and agitating the paint supply in the container 24 to produce a homogeneous suspension of the pigment in the vehicle. As will be described, the agitation is entirely automatic and substantially continuous, and yet is produced by a relatively simple and inexpensive mechanism.

In the disclosed embodiment the motor means 56 comprises an air motor including a generally cylindrical outer housing 58 having formed therewithin a cylindrical cylinder 60, an air inlet passage 62 and an air outlet passage 64. The housing is mounted on the lower side of the container lid 26 by means of an air inlet fitting 66 and an air outlet fitting 68, and is sealed with the lid by a seal 70. The air inlet fitting communicates with the air inlet passage and the air outlet fitting with the air outlet passage so that, as will be described, air under pressure may be introduced through the air inlet fitting and exhausted through the air outlet fitting to operate the motor and reciprocate the paddle 52 within the container.

A piston 72 within the cylinder 60 is slidingly sealed therewith by an annular seal 74. A valve member 76 having a passage 78 longitudinally therethrough is received and secured within the piston centrally thereof, such that an upper end of the valve member projects slightly above the upper surface of the piston. A lower end of the valve member connects with a cylindrical piston rod 80 having a chamber 82 formed therewithin in communication with the passage 78, and a lower end of the piston rod defines a threaded stud and is threadably engaged with an upper end of the agitator rod 50. The piston rod is slidingly sealed with a lower end of the housing 58 by a seal 84, and a flexible bellows 86 is connected to and about the lower end of the housing by a threaded ring 88 and to and about the juncture between the piston rod and the agitator rod by means of being captured therebetween.

The piston has a pair of passages 90 and 92 formed longitudinally therethrough, and a spool valve is associated with the piston and the valve member 76. The spool valve includes an upper plate 94 and a lower plate 96 interconnected by a pair of posts 98 and 100, and the posts extend through respective ones of the piston passages 90 and 92. The piston passages are of larger diameter than the posts, and the lengths of the posts are such that when the spool valve is in an upward position with respect to the piston the lower plate 96 is against the lower surface of the piston and seals the piston passages 90 and 92 and the upper plate 94 is elevated above the valve member 76 and opens the passage 78, and when the spool valve is in a downward position with respect to the piston the lower plate 96 is away from the lower surface of the piston and opens the piston passages 90 and 92 and the upper plate 94 is against the upper end of the valve member and closes the passage 78. A tapered coil spring 102 on the lower surface of the cover 26 within the cylinder 60 engages the upper plate 94 when the spool valve and piston are in an uppermost position, and a cylindrical coil spring 104 rests on a lower surface of the housing 58 around the piston rod 80 and engages the lower plate 96 when the spool valve and piston are in a lowermost position. A passage 106 extends through the piston rod between the chamber 82 and a chamber 108 between the piston rod and the bellows 86, the air inlet passage 62 opens into a space 110 between the piston rod and the housing above the seal 84, and the air outlet passage 64 communicates with the chamber 108.

A hose 112 between the air inlet 30 to the spray gun 22 and the air inlet fitting 66 of the motor means 56 connects air under pressure to the fitting. Under this condition, and with the piston 72 and spool valve in their lowermost position as shown in the drawings, such that the lower plate 96 of the spool valve is against the lower surface of the piston to seal the piston passages 90 and 92, air flowing through the air inlet passage 62 enters the space 110 between the piston rod and housing 58 and flows into the cylinder 60 on the lower side of the piston. This causes the plate 96 to be held against the piston and the piston to be moved in the upward direction, thereby moving the agitator paddle 52 in the upward direction. At the same time, air in the cylinder above the piston is exhausted through the passage 78, the chamber 82, the passage 106, the chamber 108 and the air outlet passage 64 for venting to atmosphere through the air outlet fitting 68.

When the piston and spool valve reach their uppermost position, the upper plate 94 of the spool valve engages the spring 102 which impedes further upward movement thereof so that, as the piston continues to rise, the spool valve moves downwardly relative to the piston. The upper plate 94 then seats against the upper end of the valve member 76 to seal the passage 78, and the lower plate 96 moves away from the lower surface of the piston to open the piston passages 90 and 92, whereby communication is provided between the portions of the cylinder 60 above and below the piston to equalize the air pressures therein. When this occurs, and since the lower portion of the piston rod 80 is exposed to air at atmospheric pressure and the upper portion to the pressure of air in the cylinder, an imbalance of forces exists which moves the spool valve and piston in the downward direction with the upper plate 94 being held against the upper surface of the valve member and sealing the passage therethrough, thereby moving the agitator paddle 52 in the downward direction.

When the spool valve and piston move downward to a point whereat the lower plate 96 of the spool valve again engages the coil spring 104, with continued downward movement of the piston the spool valve is moved upwardly relative to the piston. The lower plate 96 then engages the lower surface of the piston to seal the piston passages 90 and 92 and the upper plate 94 moves above the upper end of the valve member 76 to open the passage 78, whereupon the described cycle of operation is repeated.

Thus, upon application of air under pressure at the inlet fitting 66 the motor means 56 operates to reciprocate the agitator paddle 52 within the paint supply container 24 in directions perpendicular to the plane in which the agitator paddle lies, thereby thoroughly agitating the paint supply in the container and producing a homogeneous suspension of the pigment in the paint. Agitation is entirely automatic and continuous for so long as air is applied to the inlet fitting, and as compared with agitators of the rotary type, or of the type requiring mechanical shaking or implemented only upon actuation of the spray gun, provides significantly improved mixing of the paint.

While one embodiment of the invention has been described in detail, various modifications and other embodiments thereof may be devised by one skilled in the art without departing from the spirit and scope of the invention, as defined in the appended claims.

What is claimed is:

1. In a spray gun assembly of the type including a hand operated spray gun and an associated supply container, the improvement comprising an agitating mechanism for mixing the contents of the supply container including, in combination, an agitator carrying member one end of which extends into the interior of said container; an agitator paddle disposed interiorly of said container and mounted on said one end of said carrying member; and motor means connected with an opposite end of said carrying member for reciprocating said carrying member and thereby said paddle along a linear path, whereby said paddle agitates contents of said container, wherein said agitator paddle is generally flat and planar and is reciprocated along a path generally perpendicular to the plane thereof, and wherein said motor means comprises an air motor which receives air under pressure and reciprocates said agitator paddle in both directions along said liner path solely by means of the air under pressure, said motor means being automatically reversible in its directions of operation in response to the continuous application of air under pressure thereto.

2. In a spray gun assembly as in claim 1, wherein said supply container is provided with a top closure member and said motor means is mounted on said closure within said container.

3. In a spray gun assembly as in claim 2, wherein said carrying member comprises a rod and said agitator paddle is reciprocable within a lower portion of said container.

4. In a spray gun assembly of the type including a hand operated spray gun, an associated supply container and a closure for said container, the improvement comprising an agitating mechanism for mixing contents of the supply container including, in combination, motor means mounted on a lower surface of said closure within said container; an agitator paddle disposed interiorly of said container; and a carrying member connected between said agitator paddle and said motor means, said motor means reciprocating said carrying member and thereby said agitator paddle along a liner path, whereby said paddle agitates contents in said container, wherein said agitator paddle is generally flat and planar and is reciprocated along a path generally perpendicular to the plane thereof and in a lower portion of said container, and wherein said motor means comprises an air motor having an air inlet fitting and an air outlet fitting extending through said closure to exterior of said container, said fittings mounting said air motor on said closure, said air motor receiving air under pressure and reciprocating said agitator paddle in both directions along said linear path solely by means of the air under pressure and being automatically reversible in its directions of operation in response to the continuous application of air under pressure thereto.

5. In a spray gun as in claim 4, wherein said spray gun has a nozzle and an air inlet thereto for receiving air under pressure therein to cause the emission of fluid from said supply container through said nozzle, said agitating mechanism including an air line between said spray gun air inlet and said motor means air inlet fitting, said motor means reciprocating said paddle continuously and for as long as air under pressure is provided to said air inlet fitting.

* * * * *